US005820497A

United States Patent [19]

Pena

[11] Patent Number: 5,820,497

[45] Date of Patent: Oct. 13, 1998

[54] RELEASABLE ANCHOR FOR A POST

[76] Inventor: Roberto Pena, 1105 Farm Rd., Secaucus, N.J. 07094

[21] Appl. No.: 708,294

[22] Filed: Sep. 4, 1996

[51] Int. Cl.[6] ..... A63B 63/00; A63B 67/00

[52] U.S. Cl. ..... 473/471; 473/446; 403/374; 256/70; 256/DIG. 5

[58] Field of Search ..... 473/478, 492, 473/471, 446; 403/374, 361; 256/DIG. 5, 70, 59

[56] References Cited

U.S. PATENT DOCUMENTS

| | | | |
|---|---|---|---|
| 3,000,041 | 9/1961 | Reynolds | 403/361 X |
| 3,057,991 | 10/1962 | Grenadier | 256/59 X |
| 3,328,928 | 7/1967 | Frye | 473/492 X |
| 3,924,834 | 12/1975 | Young | 256/59 X |
| 4,619,456 | 10/1986 | Meggs | 273/127 B |
| 4,721,306 | 1/1988 | Shewchuk | 273/127 B |
| 5,039,100 | 8/1991 | Cortese | 273/127 B |

FOREIGN PATENT DOCUMENTS

| | | | |
|---|---|---|---|
| 974055 | 11/1964 | United Kingdom | 256/59 |

*Primary Examiner*—Anthony Knight
*Attorney, Agent, or Firm*—Alfred C. Hill

[57] ABSTRACT

A system to releasably anchor a post at a predetermined location on a playing surface comprising a hollow, upright post to be releasably anchored at the predetermined location on the playing surface having a bottom on the playing surface and a top remote from the bottom and the playing surface; a hollow, frustoconical member disposed within the hollow, upright post adjacent the bottom to anchor the hollow, upright post to the predetermined location on the playing surface and to enable a quick release of the hollow, upright post when forceful contact is made with the hollow, upright post; and an arrangement connected between an interior of the hollow, frustoconical member and the playing surface to secure the hollow, frustoconical member to the predetermined location on the playing surface.

20 Claims, 1 Drawing Sheet

RELEASABLE ANCHOR FOR A POST

BACKGROUND OF THE INVENTION

The present invention relates to a system to releasably secure a post for use in a sport and more particularly to a new and improved post anchoring system wherein the system provides a breakaway mount for an associated post utilized in a sporting event played on a playing surface.

In many sporting events, a post is employed to support a net used in the sporting event, such as ice hockey, rollerblade hockey, roller skate hockey, soccer, and the like which employ two goal posts to support a framework, which in turn supports a net, and it is the object of these games to place the moving component of the game, such as a puck or a soccer ball into the net to score a point. Other sporting events that employ a post to support a net employed in the sporting event is tennis in which two posts are spaced apart across the tennis court to support a net. Volleyball and badminton also employ a net supported between two posts.

In many sporting events, such as hockey, soccer, and even occasionally in tennis, volleyball, and badminton a player may collide with the post and could be seriously injured by such a collision. These collisions are prevented by having breakaway posts which will reduce the injury to the player. In the past to overcome these injuries, the net has been loosely secured on the playing surface by the posts so that whenever it is contacted by a player it simply moves away from the original location and no damage is caused. However, this becomes unsatisfactory as the players become older and more skilled, since the net can be very easily moved away from its location, even when not impacted and, thus, the game has to come to a halt.

Prior art which has addressed this problem includes:

U.S. Pat. No. 5,039,100 issued to R. A. Cortese which discloses a magnetic structure to hold the posts in a secured, but breakaway condition;

U.S. Pat. No. 4,721,306 issued to J. G. Shewchuk which discloses a post having a breakaway feature or system that employs springs and cables as the breakaway feature;

U.S. Pat. No. 4,619,456 issued to D. Meggs discloses another system for releasably securing a hockey goal post to the playing surface which again employs a magnetic arrangement to accomplish the securing and breakaway feature to prevent injuries;

U.S. Pat. No. 4,420,158 issued to L. E. Klock et al discloses a rope mounting arrangement for the goal posts;

U.S. Pat. No. 3,979,120 issued to J. S. Dietrich discloses a restorable deformable hockey goal which is restorably deformable at the joint ends of the net; and U.S. Pat. No. Des 358,184 issued to J. D. Amburgey et al, a design patent, which discloses a design of a folding soccer and hockey goal.

The prior art patents cited above all require a complicated magnetic arrangement, a complicated spring and cable arrangement and a complicated rope arrangement to mount and secure in a releasable manner the post of a facility used in a sporting event, such as a hockey goal.

SUMMARY OF THE INVENTION

An object of the present invention is to provide an improved system to releasably anchor a post for a sporting event at a predetermined location on a playing surface.

Another object of the present invention is to provide a system to releasably secure a post at a predetermined location on a playing surface for the sporting events, such as ice hockey, rollerblade hockey, roller skate hockey, soccer, badminton, volleyball, tennis and the like.

A feature of the present invention is the provision of a system to releasably anchor a post at a predetermined location on a playing surface comprising a hollow, upright post to be releasably secured at a predetermined location on the playing surface having a bottom adjacent the playing surface and a top remote from the bottom and the playing surface; a hollow, frustoconical member disposed within the hollow, upright post adjacent the bottom thereof to anchor the hollow, upright post to the predetermined location on the playing surface and to enable a quick release of the hollow, upright post when forceful contact is made with the hollow, upright post; and a means connected between an interior of the hollow, frustoconical member and the playing surface to secure the hollow, conical member to the predetermined location on the playing surface.

Another feature of the present invention is the provision of a system to releasably anchor a pair of posts to a playing surface, each of the pair of posts being disposed at a different one of two spaced predetermined locations on the playing surface comprising a pair of hollow, upright posts, each being anchored at a different one of the two spaced predetermined locations and having a bottom adjacent the playing surface and a top remote from the bottom and the playing surface; a pair of hollow, frustoconical members, each being disposed within a different one of the pair of hollow, upright posts adjacent the bottom to anchor each of the pair of posts to its associated one of the two spaced predetermined locations on the playing surface and to enable a quick release of each of the pair of hollow, upright posts once forceful contact is made with each of the pair of hollow, upright posts; a pair of means each connected between an interior of an associated one of the pair of hollow, frustoconical members and the playing surface to secure each of the pair of hollow, conical members to an associated one of the two spaced predetermined locations on the playing surface; and net means secured to and extending between each of the pair of hollow, upright posts.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENTS

Figure 1:
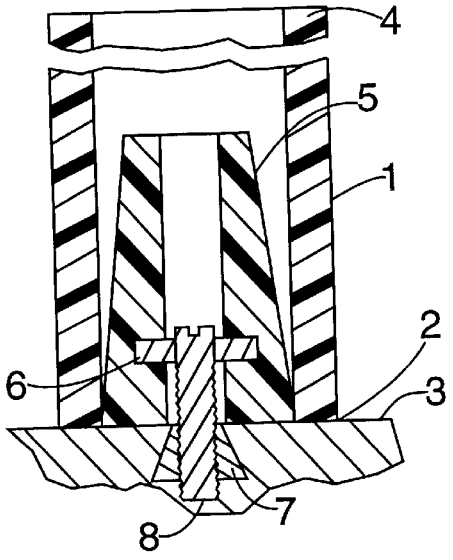
FIG. 1 is a cross-sectional view of a first embodiment of a system to releasably anchor a post in accordance with the principles of the present invention.

Referring to FIG. 1, the system to releasably anchor a post at a predetermined location on a playing surface includes a hollow post 1 to be releasably anchored having a bottom 2 adjacent the playing surface 3 and a top 4 remote from the bottom 2 and the playing surface 3. A hollow, frustoconical member 5 is disposed within the hollow, upright post 1 adjacent the bottom 2 to anchor the post 1 to a predetermined location on the playing surface 3 and due to the frustoconical configuration to enable a quick release of the hollow post 1 when forceful contact is made with post 1 by a player in the sporting event. A washer 6 is disposed within and secured to the interior of the hollow, frustoconical member 5 parallel to the playing surface 3. An anchor 7 is embedded in the playing surface 3 at the predetermined location and a screw or bolt 8 extends through washer 6 into anchor 7 to secure the frustoconical member 5 to the predetermined location on the playing surface 3.

Figure 2:
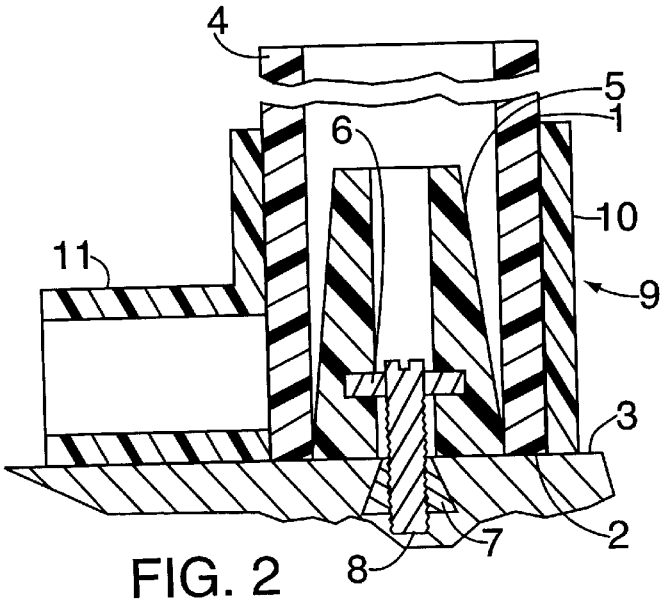
FIG. 2 is a cross-sectional view of a second embodiment of a system to releasably anchor a post in accordance with the principles of the present invention.

Referring to FIG. 2, the second embodiment of the system to releasably anchor a post is disclosed. In this embodiment the same components shown in FIG. 1 are employed and identified with the same reference characters as employed in FIG. 1. The embodiment shown in FIG. 2 additionally includes, an elbow 9 having a first member or portion 10 coaxial with and surrounding the post 1 adjacent the bottom 2. Elbow 9 further includes a second member or portion 11 disposed at right angles to the first member or portion 10 adjacent the bottom 2 of the post 1 to enable attaching a framework to the hollow, upright post 1 to support a goal net.

Figure 3:
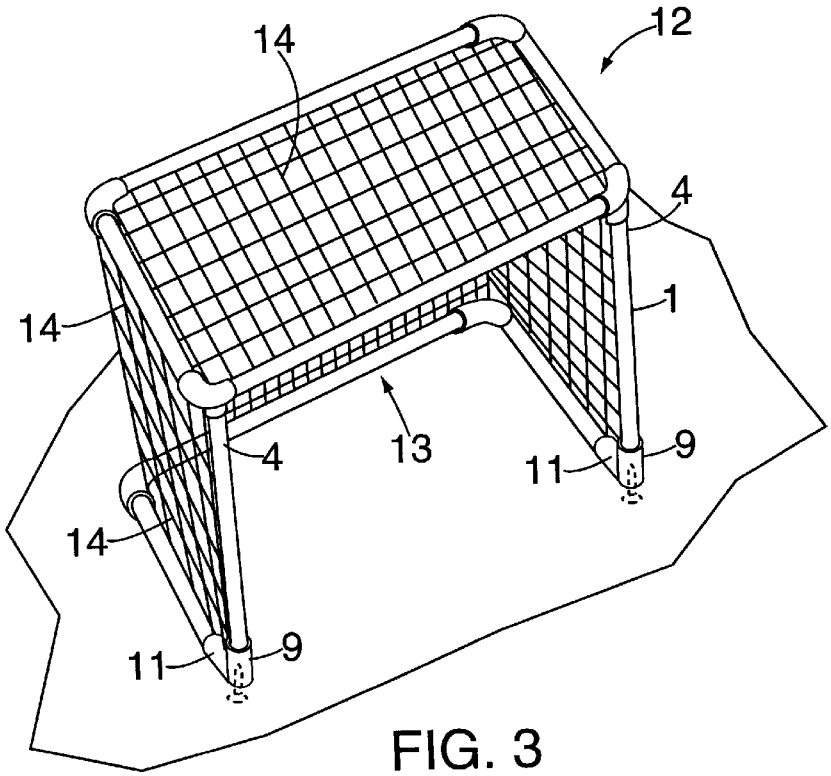
FIG. 3 is a perspective view of a hockey or soccer goal that incorporates the system of FIG. 2 to releasably anchor a post in accordance with the principles of the present invention.

Referring to FIG. 3, there is illustrated therein a hockey or soccer goal 12 which includes the arrangement or embodiment illustrated in FIG. 2 including two posts 1 to provide the mouth of the goal and which incorporates the elbow 9 at both of these posts to enable securing a framework 13 supporting a goal net 14. Framework 13 extends between the two posts 1 and is secured to each of the second member or portions 11 of the elbow 9 and to the top 4 of each of the hollow posts 1.

It has been found that numerous materials can be used to provide the goal and to also releasably anchor the goal posts. However, it is preferable to use PVC piping for the post 1 and to have the frustoconical member 5 made from either soft rubber or polyurethane. The washer 6, the anchor 7 and the screw 8 can be metallic, such as steel, or it could be a high impact and high resistant plastic.

As previously mentioned, the system to releasably secure a post as described hereinabove can be employed in ice hockey, rollerblade hockey, roller skate hockey, soccer, volleyball, badminton, tennis and any other sport requiring a post that should have a quick release when contacted by a player of the sporting event.

While I have described the principles of my invention in connection with specific apparatus, it is to be clearly understood that this description is made only by way of example and not as a limitation to the scope of my invention as set forth in the objects thereof and in the accompanying claims.

I claim:

1. A system releasably anchoring a post at a predetermined location on a playing surface comprising:

a hollow, upright post releasably anchored at said predetermined location on said playing surface having a bottom on said plating surface and a top remote from said bottom and said playing surface;

a hollow, frustoconical member having a base on said playing surface and a flat surface parallel to said base spaced upward from said playing surface, said base having a predetermined diameter and said flat surface having a diameter less than said predetermined diameter, said hollow, frustoconical member being disposed within said hollow, upright post adjacent said bottom to anchor said hollow, upright post to said predetermined location on said playing surface, said hollow, frustoconical member's shape enabling a quick release of said hollow, upright post when forceful contact is made with said hollow, upright post; and a means connected between an interior of said hollow, frustoconical member and said playing surface to secure said hollow, frustoconical member to said predetermined location on said playing surface.

2. A system according to claim 1, wherein said hollow, upright post is a hollow PVC post.

3. A system according to claim 1, wherein said hollow frustoconical member is a soft rubber frustoconical member.

4. A system according to claim 1, wherein said hollow frustoconical member is a polyurethane frustoconical member.

5. A system according to claim 1, wherein said means includes a washer disposed within and secured to said hollow, frustoconical member parallel to said playing surface, an anchor means embedded in said playing surface at said predetermined location, and a screw type means extending through said washer into said anchor means to secure said hollow, frustoconical member to said predetermined location on said playing surface.

6. A system according to claim 1, wherein said means is a non-magnetic means.

7. A system according to claim 6, wherein said non-magnetic means includes a washer disposed within and secured to said hollow, frustoconical member parallel to said playing surface, an anchor means embedded in said playing surface at said predetermined location, and a screw type means extending through said washer into said anchor means to secure said hollow, frustoconical member to said predetermined location on said playing surface.

8. A system according to claim 1, further including a first member coaxial with and surrounding said hollow, upright post at said bottom thereof;

a second member disposed at a right angle to said first member at said bottom of said hollow, upright post to enable attaching a framework to said hollow, upright post; and a goal net supported by said framework.

9. A system according to claim 1, further including an elbow having a first portion coaxial with and surrounding said hollow, upright post adjacent said bottom of said hollow, upright post; and a second portion disposed at a right angle to said first portion adjacent said bottom of said hollow, upright post; and a framework supporting a goal net secured to said second portion and said top of said hollow, upright post.

10. A system releasably anchoring a pair of posts to a playing surface, each of said pair of posts being disposed at a different one of two spaced predetermined locations on said playing surface comprising:

a pair of hollow, upright posts, each anchored at a different one of said two spaced predetermined locations and having a bottom on said playing surface and a top remote from said bottom and said playing surface;

a pair of hollow, frustoconical members each having a base on said playing surface and a flat surface spaced upward from said playing surface and said base, said base having a predetermined diameter and said flat surface having a diameter less than said predetermined diameter, each of said pair of frustoconical members being disposed within a different one of said pair of hollow, upright posts adjacent the bottom to anchor each of said pair of hollow, upright posts to its associated one of said two spaced predetermined locations on said playing surface, each of said hollow, frustoconical member's shape enabling a quick release of each of said pair of hollow, upright posts when forceful contact is made with each of said pair of hollow, upright posts; and a pair of means, each connected between an interior of an associated one of said hollow, frustoconical members and said playing surface to secure each of said hollow, frustoconical members to an associated one of said two spaced predetermined locations on said playing surface.

11. A system according to claim 10, further including net means secured to and extending between each of said pair of hollow, upright posts.

12. A system according to claim 11, wherein each of said pair of hollow, upright posts is a PVC post.

13. A system according to claim 11, wherein each of said pair of hollow, frustoconical members is a selected one of a soft rubber, hollow frustoconical member and a polyurethane, hollow frustoconical member.

14. A system according to claim 11, wherein said pair of means each includes a washer disposed within and secured to an associated one of said pair of hollow, frustoconical members parallel to said playing surface, an anchor means embedded in said playing surface at an associated one of said two spaced predetermined locations on said playing surface, and a screw type means extending through said washer into said anchor means to secure said associated one of said pair of hollow, frustoconical member to said associated one of said two spaced predetermined locations on said playing surface.

15. A system according to claim 11, wherein each of said pair of means is a non-magnetic means.

16. A system according to claim 15, wherein said pair of non-magnetic means each includes a washer disposed within and secured to an associated one of said pair of hollow, frustoconical members parallel to said playing surface, an anchor means embedded in said playing surface at an associated one of said two spaced predetermined locations on said playing surface, and a screw type means extending through said washer into said anchor means to secure said associated one of said pair of hollow, frustoconical members to said associated one of said two spaced predetermined locations on said playing surface.

17. A system according to claim 10, further including a goal net secured to and extending between each of said pair of hollow, upright posts.

18. A system according to claim 10, further including a pair of first members, each coaxial with and surrounding a different one of said pair of hollow, upright posts at said bottom thereof; and a pair of second members, each disposed at a right angle with respect to an associated one of said pair of first members at said bottom of an associated one of said pair of hollow, upright post to enable attaching a framework supporting a goal net to and between each of said pair of hollow, upright posts.

19. A system according to claim 10, further including a pair of elbows each having a first portion coaxial with and surrounding an associated one of said pair of hollow, upright posts adjacent said bottom thereof, and a second portion disposed at a right angle to said first portion adjacent said bottom of said associated one of said pair of hollow, upright posts; and a framework supporting a goal net extending between and secured to each of said second portion of said pair of elbows and said top of each of said pair of hollow, upright posts.

20. A system according to claim 19, wherein said pair of means each includes a washer disposed within and secured to an associated one of said pair of hollow, frustoconical members parallel to said playing surface, an anchor means embedded in said playing surface at an associated one of said two spaced predetermined locations on said playing surface, and a screw type means extending through said washer into said anchor means to secure said associated one of said pair of hollow, frustoconical members member to said associated one of said two spaced predetermined locations on said playing surface.

* * * * *